US008772687B2

(12) United States Patent
Boxman et al.

(10) Patent No.: US 8,772,687 B2
(45) Date of Patent: Jul. 8, 2014

(54) MICROWAVE OVEN WINDOW

(75) Inventors: Revuen Boxman, Herzliya (IL); Vladimir Dikhtyar, Tel Aviv (IL); Evgeny Gidalevich, Ramle (IL); Vladimir Zhitomirsky, Haifa (IL)

(73) Assignee: Clear Wave, Ltd., Herzliya (IL)

( * ) Notice: Subject to any disclaimer, the term of this patent is extended or adjusted under 35 U.S.C. 154(b) by 1646 days.

(21) Appl. No.: 12/210,230

(22) Filed: Sep. 15, 2008

(65) Prior Publication Data

US 2009/0008387 A1 Jan. 8, 2009

Related U.S. Application Data

(63) Continuation-in-part of application No. 12/090,356, filed as application No. PCT/IL2006/001177 on Oct. 15, 2006, now abandoned.

(60) Provisional application No. 60/727,875, filed on Oct. 19, 2005.

(51) Int. Cl.
*H05B 6/64* (2006.01)

(52) U.S. Cl.
USPC ..... 219/757; 219/756

(58) Field of Classification Search
USPC ..... 219/678–757
See application file for complete search history.

(56) References Cited

U.S. PATENT DOCUMENTS

| | | | | |
|---|---|---|---|---|
| 2,748,351 | A * | 5/1956 | Varnerin, Jr. | 333/13 |
| 2,920,174 | A * | 1/1960 | Haagensen | 219/685 |
| 3,813,265 | A * | 5/1974 | Marks | 427/473 |
| 4,010,343 | A * | 3/1977 | Tanaka et al. | 219/740 |
| 4,591,683 | A * | 5/1986 | Eke | 219/681 |
| 4,795,873 | A * | 1/1989 | Freedman et al. | 219/728 |
| 5,981,927 | A | 11/1999 | Osepchuk et al. | |
| 6,353,220 | B1 * | 3/2002 | Sar | 250/239 |
| 6,822,208 | B2 | 11/2004 | Henze et al. | |
| 7,078,661 | B2 | 7/2006 | Kim et al. | |
| 7,294,811 | B2 * | 11/2007 | Kawashima et al. | 219/405 |
| 2004/0164075 | A1 * | 8/2004 | Henze et al. | 219/740 |
| 2004/0253471 | A1 * | 12/2004 | Thiel et al. | 428/544 |

OTHER PUBLICATIONS

C. Tsakonas et al; Optically Transparent Frequency Selective Window for Microwave Applications; Electronics Letters; Nov. 22, 2001; pp. 1464-1466; IEEE, New York, NY.

Office Action Apr. 26, 2012 for related U.S. Appl. No. 12/090,356.

* cited by examiner

*Primary Examiner* — Dana Ross
*Assistant Examiner* — Thomas Ward
(74) *Attorney, Agent, or Firm* — Simon Kahn

(57) ABSTRACT

An observation window for a microwave device exhibiting microwave radiation of a predetermined frequency, the observation window comprising two optically transparent panels to which an optically transparent conductive film has been applied to a single side thereof, each of the transparent conductive films primarily reflecting incident microwave radiation and being substantially parallel and spatially separated from each other by a predetermined distance, the predetermined distance being equal to an odd integer multiple of one quarter of the wavelength of the microwave radiation of the predetermined frequency in the interstice between the transparent films, the predetermined distance having a tolerance of plus or minus 0.15 of the wavelength in the interstice.

21 Claims, 6 Drawing Sheets

MICROWAVE OVEN WINDOW

CROSS-REFERENCE TO RELATED APPLICATIONS

This application is continuation in part of U.S. patent application Ser. No. 12/090,356 filed Apr. 16, 2008, which is a National Phase of PCT Patent Application No. PCT/IL2006/001177 having an International Filing Date of Oct. 15, 2006, which claims the benefit of U.S. Provisional Patent Application Ser. No. 60/727,875 filed Oct. 19, 2005 entitled "Microwave Oven Window", the entire contents of each of which is incorporated herein by reference.

TECHNICAL FIELD

This invention pertains to the field of optically transparent windows and in particular to an optically transparent window exhibiting attenuation for microwave radiation.

BACKGROUND

Microwave ovens are common domestic appliances used for heating food. Generally they operate at a fixed frequency of 2.45 GHz, which is allocated for industrial use by national regulatory authorities and international agreement. It is desirable on the one hand to equip the oven with a window permitting observation of the food during heating and cooking, while it is necessary on the other hand to prevent harmful levels of microwave radiation from escaping from the oven, and potentially harming people in the vicinity of the oven. Today this is commonly accomplished by fitting the door of the oven with a double glazed window exhibiting a metal grid in the inter-pane region, or a by the use of a metal grid covered on both sides by plastic sheets. The metal grid is typically fabricated from a metal sheet, in which a multiplicity of small holes have been punched, or by using a woven or expanded metallic screen, characterized by a periodic array of openings separated by metal. Each hole or opening is much smaller than the wavelength of approximately 12.2 cm of the 2.45 GHz radiation, and thus the microwave power which escapes through the grid is greatly attenuated.

While these grids are effective in reducing the radiation to what has been determined to be safe levels, the visibility of the oven contents through the grid is generally poor. It is desirable to have an oven window with greater visibility, while providing adequate attenuation of the microwave radiation to meet safety standards.

Several inventions have been proposed to improve visibility using thin films which attenuate microwave radiation. U.S. Pat. No. 2,920,174 to Haagensen issued Jan. 5, 1960, hereinafter the '174 patent, the entire contents of which are incorporated herein by reference, teaches the use of thin metallic thin films to reflect microwave radiation while transmitting optical radiation. The '174 patent further teaches that the effective thickness of a metal film may be increased by metallizing opposed surfaces of a base member. Unfortunately, a practical microwave oven window utilizing inexpensive commercially available materials is not taught by the '174 patent.

U.S. Pat. No. 5,981,927 to Osepchuk et al. issued Nov. 9, 1999, the entire contents of which are incorporated herein by references, teaches the use of an absorbing film together with a metal screen. The requirement for a metal screen does not satisfactorily resolve the issue of visibility.

U.S. Pat. No. 6,822,208 issued Nov. 23, 2004 to Henze et al, the entire contents of which is incorporated herein by reference, teaches the use of a optically transparent microwave absorbing first film and an optically transparent microwave reflecting second film. Henze et al. intends for the first film to not only attenuate microwave transmission, but also to use the absorbed microwave energy to heat itself, and a transparent panel which supports it, and thus to prevent water condensation which could occlude visibility.

Microwave absorbing films have several disadvantages including: they absorb microwave energy intended for heating the contents of the oven; and in so doing, they, and the substrate supporting them, are heated, and can reach substantially elevated temperatures. Such elevated temperatures can constitute a safety hazard, since a user removing food or other contents from the oven might be injured touching the inside window. Furthermore, the periodic heating and cooling can compromise the integrity of the window by periodically stressing the interface between the film and the substrate and hence encouraging delamination of the film, and by producing thermal stresses in the substrate which exceed its yield strength, and hence causing the substrate to crack.

It should be noted that all materials, and in particular thin films, can simultaneously interact with microwave radiation in several ways, including by absorption, reflection, and transmission of the microwave radiation. Since all materials absorb microwave radiation to some degree, the term absorbing film as used herein is meant to describe a film where absorption is the primary interaction. Furthermore, it should be noted that the degrees of absorption, reflection, and transmission of a thin film, and specifically a film whose thickness is much less than the wavelength and skin depth at the radiation frequency of interest, are controlled primarily by a quantity known as the surface resistivity denoted as R, and $R=\rho/d$, where $\rho$ is the resistivity of the thin film material (expressed in International Standard units of Ohm-meters), and d is the film thickness. R is usually expressed in terms of "Ohms per square" [Ω/□]. This is the resistance which would be measured between perfectly conductive electrodes fitted along the length of any two opposing sides of a square sample of the film of any size. The influence of R on the absorption, reflection and transmission for a simple idealized example of a plane wave normally incident on a planar film with infinite lateral extent, having a surface resistivity of R, is illustrated in FIG. 1, where the x-axis denotes surface resistivity in Ω/□ and the y-axis denotes the coefficient of absorption, reflection and transmission respectively. Curve 2 plots the absorption coefficient as a function of R, curve 4 plots the reflection coefficient as a function of R and curve 6 plots the transmission coefficient as a function of R. The power absorption, reflection, and transmission coefficients are given respectively by Equations 1-3:

$$\frac{S_a}{S_i} = \frac{\left(4\left(\frac{R}{\eta}\right)\right)}{\left(1+2\left(\frac{R}{\eta}\right)\right)^2} \quad \text{Eq. 1}$$

$$\frac{S_r}{S_i} = \frac{1}{\left(1+2\left(\frac{R}{\eta}\right)\right)^2} \quad \text{Eq. 2}$$

$$\frac{S_t}{S_i} = \left(\frac{2\left(\frac{R}{\eta}\right)}{1+2\left(\frac{R}{\eta}\right)}\right)^2 \quad \text{Eq. 3}$$

where $\eta=377\Omega$ is the impedance of free space, S is the power flux, and the subscripts i, a, r, and t refer to the incident, absorbed, reflected, and transmitted powers.

It should be noted that R is inversely proportional to the film thickness d, and thus a given electrically conductive material can act primarily as a transmitter, absorber, or reflector of microwave energy, depending upon its thickness. Thus a very thin film of electrically conductive material with a very large surface resistivity, e.g. $R>377\Omega/\square$, will primarily transmit incident microwave radiation, while a similarly constituted film of intermediate thickness such that $94\Omega/\square<R<377\Omega/\square$ will primarily absorb incident microwave radiation, and a similarly constituted film of a greater thickness such that $R<94\Omega/\square$ will primarily reflect incident microwave radiation. While these numbers pertain to the specific idealized example examined, the principle here described is general. Henze et. al., for example, teach using a first film with a surface resistivity of $200\Omega/\square$ denoted point 8 on FIG. 1. As may be seen in FIG. 1, this is the value of R yielding the largest absorption coefficient, 0.5.

The prior art teaches the use of various materials for thin films which are both optically transparent and electrically conductive, including metals, and in particular transparent conductive oxides such as indium tin oxide and various doped and undoped varieties of tin oxide and zinc oxide, as well as various techniques of depositing these thin films, including various wet chemical, physical vapor deposition, and chemical vapor deposition techniques. Some of these techniques are expensive to apply, while others yield poor adhesion or other properties. One technique in particular, however, atmospheric pressure chemical vapor deposition, applied in-line during the fabrication of float glass, provides good adhesion, good electrical and optical properties, and glass provided with this coating is commercially available at a relatively low price.

Thus, the prior art does not describe a low cost microwave oven window exhibiting good optical transmission. Furthermore, despite the long history of microwave ovens, a microwave oven with a suitable optically transparent window remains commercially unavailable,

SUMMARY

Accordingly, it is a principal object to overcome at least some of the disadvantages of prior art. This is provided in certain embodiments by a microwave oven window exhibiting improved visibility while attenuating microwave radiation, the microwave oven window comprising a pair of optically transparent panels, such as float glass, to which a substantially transparent conductive film which reflects microwave radiation has been applied to a single major surface thereof. The two transparent conductive films are optimally spatially separated by a predetermined distance equal to approximately an odd number of quarter wavelengths of the microwave radiation in the interstice between the two films. In certain embodiments, the microwave oven window is comprised of two parallel panes of float glass where the uncoated major faces abut each other thereby defining the interstice. In one particular embodiment the transparent conductive film is applied by atmospheric pressure chemical vapor deposition, applied in-line during the fabrication of the float glass.

In one embodiment visibility is further improved by placing a gas discharge lamp within the oven cavity, such that it is energized by the microwave radiation produced during oven operation.

In another embodiment, water condensation on the microwave oven window, which can occlude visibility and cause cracking, is reduced or prevented by providing effective ventilation, which continues for a pre-determined time after the application of microwave radiation is completed.

Additional features and advantages of the invention will become apparent from the following drawings and description.

BRIEF DESCRIPTION OF THE DRAWINGS

For a better understanding of certain embodiments and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments only, and are presented in the cause of providing what is believed to be the most useful and readily understood description of the principles and conceptual aspects. In this regard, no attempt is made to show structural details in more detail than is necessary for a fundamental understanding, the description taken with the drawings making apparent to those skilled in the art how the several forms may be embodied in practice. In the accompanying drawings.

DETAILED DESCRIPTION

Figure 1:
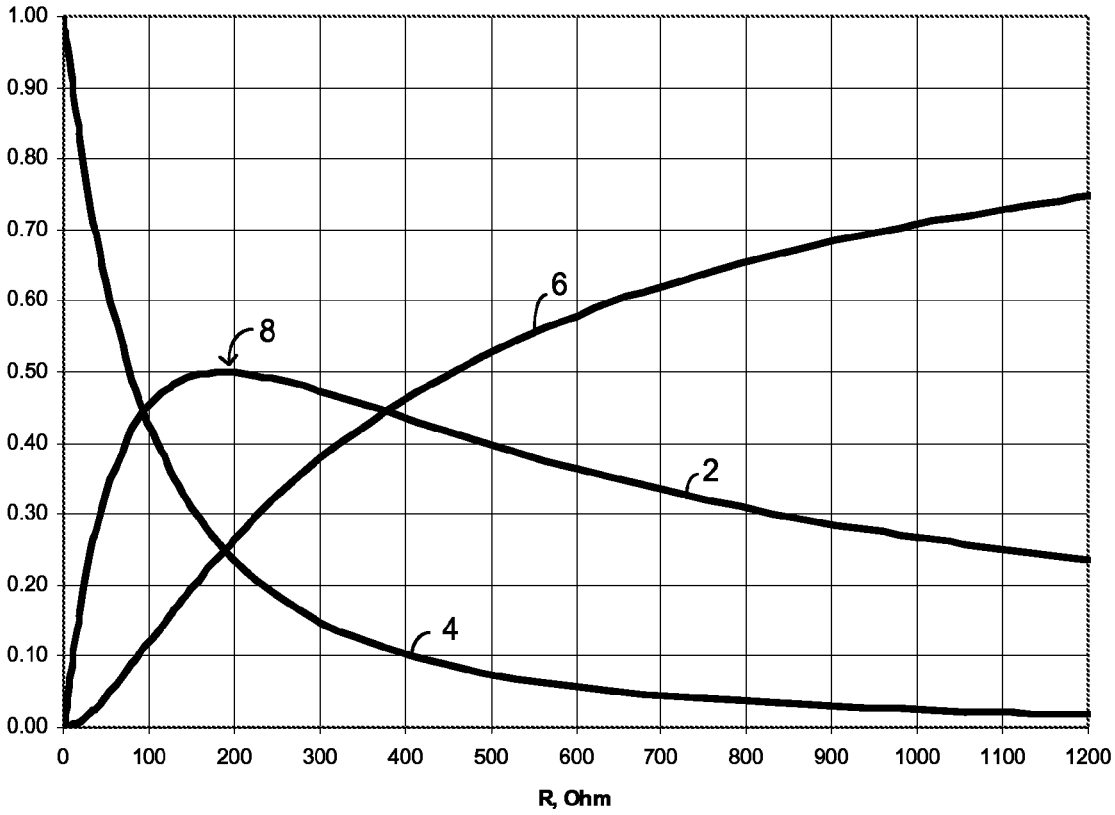
FIG. 1 is a graph of the calculated reflection, transmission, and absorption coefficients as a function of surface resistivity, for a plane wave normally incident on an infinitely wide thin film.

Certain embodiments enable a microwave oven window exhibiting improved visibility while attenuating microwave radiation, the microwave oven window comprising a pair of optically transparent panels, such as float glass, to which a substantially transparent conductive film which reflects microwave radiation has been applied to a single major surface thereof. The two transparent conductive films are optimally spatially separated by a predetermined distance equal to approximately an odd number of quarter wavelengths of the microwave radiation in the interstice between the two films. In certain embodiments, the microwave oven window is comprised of two parallel panes of float glass where the uncoated major faces abut each other thereby defining the interstice. In one particular embodiment the transparent conductive film is applied by atmospheric pressure chemical vapor deposition, applied in-line during the fabrication of the float glass.

In one embodiment visibility is further improved by placing a gas discharge lamp within the oven cavity, such that it is energized by the microwave radiation produced during oven operation.

In another embodiment, water condensation on the microwave oven window, which can occlude visibility and cause cracking, is reduced or prevented by providing effective ventilation, which continues for a pre-determined time after the application of microwave radiation is completed.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

A microwave oven generally comprises a source of microwave radiation such as a magnetron, and a chamber which serves as a multi-mode microwave cavity. Usually the chamber has a three-dimensional rectangular shape, and is thus enveloped by 6 rectangular walls. Usually five of these walls are manufactured from a metal, and one of the walls, e.g. the top wall or a side wall, is fitted with an aperture to allow coupling from the microwave source into the chamber. Usually one wall is in the form of a door to allow access to the chamber, e.g. for inserting and removing food to be heated in the oven. Generally this door is fitted with an observation window to allow visual observation of the contents of the oven during heating, and heretofore, the nature of this microwave oven window is typically of the prior art perforated metal construction described above, thereby exhibiting limited visibility of the contents.

Figure 2:
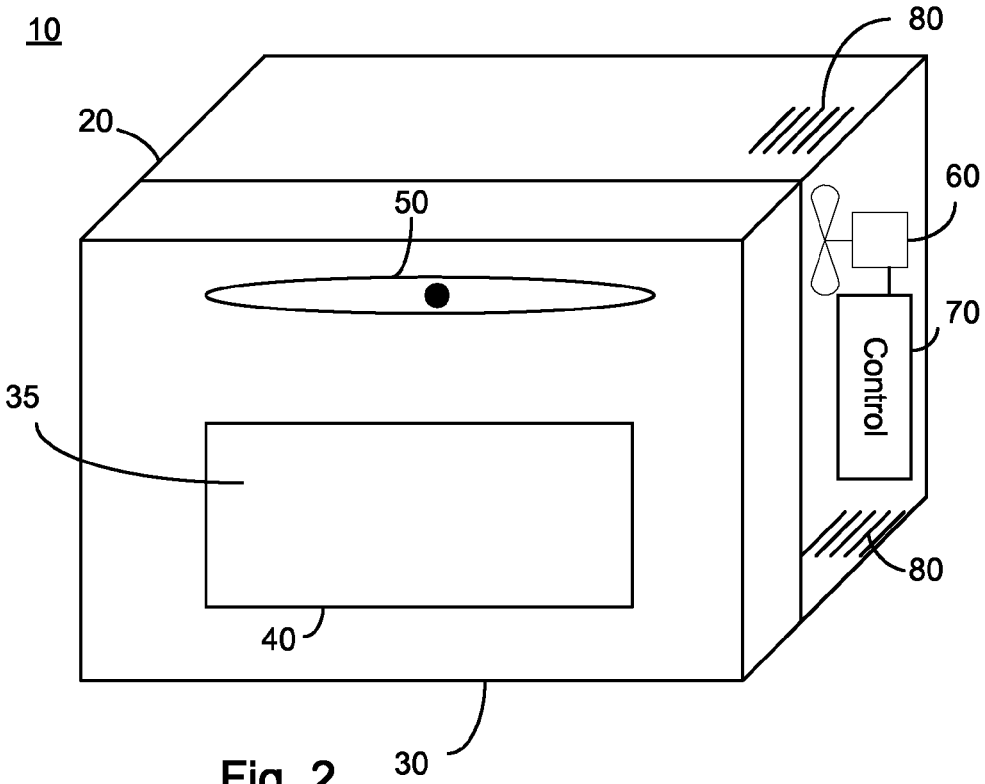
FIG. 2 is a schematic diagram of an embodiment of a microwave oven, showing the placement of an observation window.

FIG. 2 is a schematic diagram of an embodiment of a microwave oven 10, showing the placement of an observation window. Microwave oven 10 comprises a plurality of walls 20 constituted generally of metal and a door 30 containing therein an observation window 40, walls 20 and door 30 defining a chamber 35. In general, the metal walls 20, being good electrical conductors, reflect a large portion of microwave radiation incident upon them, thus enhancing the transfer of microwave radiation to the objects (e.g. food) placed within chamber 35, and preventing dangerous radiation from escaping from chamber 35. Disposed within chamber 35 is a gas discharge lamp 50. A fan 60 responsive to a control unit 70 communicates with a plurality of ventilation ducts 80.

The visibility of the contents of a microwave oven located in chamber 35 can be improved not only by eliminating the metal grid from the microwave oven window, but also by improving the illumination within the oven. Prior art ovens are usually illuminated by a low power incandescent lamp located in the space between the inner and outer walls of the oven. Holes are punched in the inner wall to transmit the light into the oven enclosure while attenuating microwave radiation from the oven enclosure. In certain embodiments, gas discharge lamp 50 is placed directly in oven chamber 35. In a preferred embodiment, no wires are attached to gas discharge lamp 50, but rather gas discharge lamp 50 is energized by the microwave radiation in chamber 35. In a preferred embodiment, gas discharge lamp 50 comprises a fluorescent lamp. Prior art standard fluorescent lamps are advantageous because they are readily available and low cost, and produce a pleasant white light which illuminates the oven contents effectively and pleasantly. Gas discharge lamp 50 serves additional useful functions besides providing illumination. It also serves as an indicator that microwave energy is present and it serves as a microwave power regulating device, by acting as a load, and thus absorbing microwave energy, particularly when chamber 35 is empty. This limits the power flux to the transparent conducting material in observation window 40, and thus helps prevent observation window 40 from overheating and subsequent damage if microwave oven 10 is operated without any contents.

Water evaporated from food in a microwave oven chamber, such as chamber 35, can condense on cool oven walls and, in particular, on the inner surface of the microwave oven window. This can interfere with visibility of the contents, and may also encourage crack formation. In certain embodiments, oven chamber 35 is provided with a continuous flow of air, driven with fan 60. In one embodiment, the air is first directed past the magnetron or other microwave generator, and then directed into chamber 35, and evacuated. This has the advantages of cooling the microwave generator, and providing heated air to chamber 35, which can absorb a greater amount of water vapor than cooler air. In certain embodiments, fan 60 is operated by a control unit 70, such that it operates all of the time that the microwave generator is operated, and ceases only after some predetermined time, typically 0.5 to 2 minutes, after the microwave generator is turned off. Fan 60 communicates with ducts 80 to bring outside air into chamber 35. This will help prevent condensation on observation window 40 during the period after heating by the microwave. Preferably the predetermined time is greater than the time required to exchange the volume of air in said chamber.

Certain embodiments address the visibility of the contents placed in chamber 35, and in particular, the optical transparency of observation window 40, which according to the prior art generally provides only poor visibility of the oven contents. Preferably, thin films of a material selected to exhibit both good optical transmission and electrical conductivity are used to reflect microwave radiation, incident upon them from chamber 35, back into chamber 35. Furthermore, preferably at least two of these films are disposed parallel to each other, and spaced apart by an odd multiple of a quarter-wavelength of the microwave radiation plus or minus 0.15 wavelength. The wavelength is defined in the interstice between the films. This forms a microwave etalon which effectively enhances the reflectance.

Figure 3:
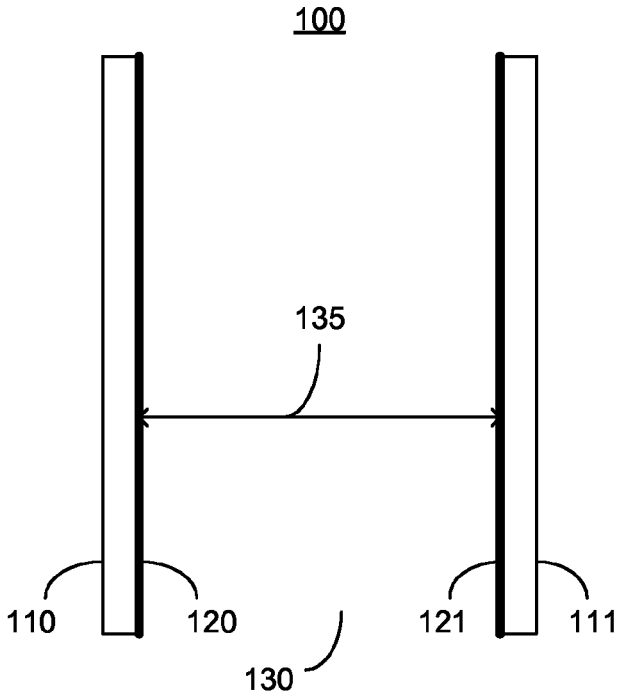
FIG. 3 is a schematic diagram showing an embodiment of a microwave oven window in which the transparent films are supported by a plurality of transparent panels.

An embodiment of this concept is illustrated in FIG. 3, which is a schematic diagram showing an embodiment of a microwave oven window in which the transparent films are supported by a plurality of transparent panels forming an etalon 100. Etalon 100 is formed by a first transparent conductive film 120 and a second transparent conductive film 121 separated by an interstice 130. Interstice 130 exhibits a length 135 equal to a quarter wavelength of the microwave radiation in interstice 130. Length 135 is preferably determined by the formula $$L = \frac{c}{4f\sqrt{k}} \qquad \text{Eq. 4}$$

where c is the speed of light in vacuum, f is the frequency of the microwave radiation, and k is the dielectric constant of the constituent material of interstice 130. The value of k for air is approximately unity. Transparent conductive films 120, 121 are preferably supported by a first transparent panel 110 and a second transparent panel 111, respectively, having been applied to a major surface thereof. First transparent conductive film 120 is shown applied to a major surface of first transparent panel 110 facing interstice 130 and second film 121 is applied to a major surface of second transparent panel 111 facing interface 130, however this is not meant to be limiting in any way. In another embodiment (not shown) at least one of first transparent conductive film 120 and second transparent conductive film 121 are secured to a major surface of the respective transparent panel 110, 111 facing away from interstice 130. In one embodiment first and second transparent panels 110, 111 are comprised of glass, preferably float glass. In other embodiments first and second transparent panels 110, 111 are comprised of a transparent polymer material such as polycarbonate or acrylic. Preferably etalon 100 is within a framework, preferably constructed of a metal or other conducting material, to prevent radiation leakage from the edges of interstice 130.

First and second transparent conductive films 120, 121 may be fabricated by a variety of techniques known to those skilled in the art including variants of chemical vapor deposition (CVD) such as spray pyrolysis or on-line deposition as part of the float glass manufacturing process, and variants of physical vapor deposition (PVD) including, for example and without limitation, evaporation, sputtering, or filtered vacuum arc deposition. In one embodiment the transparent conductive films are composed of a very thin layer of metal such as silver, and in another embodiment the transparent conductive films are composed of any one of various transparent conductive oxide (TCO) materials, including, without limitation: indium oxide; indium tin oxide (ITO); tin oxide; tin oxide doped with fluorine (F) or antimony (Sb); zinc oxide; and zinc oxide doped with aluminum (Al). TCO materials are conductive when the amount of oxygen is slightly less than the stoichiometric ratio, or if they are doped by an appropriate material, e.g. by F or Sb in the case of tin oxide, or Al in the case of zinc oxide. Transparent conductive films 120, 121 preferably exhibit a thicknesses ranging from about 5 nm to 5 μm. In some embodiments, it will be advantageous to fabricate the films from multiple layers of different materials. In one embodiment multi-layer transparent conducting films contain layers of a metal and layers of a TCO. In another embodiment multi-layer transparent conducting films comprise layers of a metal, layers of a TCO and layers of one or more transparent dielectric materials. The design of such "stacks" of layers is well known to those skilled in the art, and the design of the transparent conductive multi-layer film can be tailored to obtain different degrees of conductivity, optical transmission, and resistance to environmental degradation.

Transparent conductive optical films according to certain embodiments preferably exhibit a resistivity of less than 150Ω/□. Further preferably, transparent conductive optical films according to certain embodiments exhibit a resistivity of less than 94Ω/□. Further preferably, transparent conductive optical films according to certain embodiments exhibit a resistivity of between 2 and 20Ω/□.

Generally the conductivity of thin transparent films is limited, and is characterized by the surface resistivity R, which as described above is usually expressed in terms of Ω/□. In principle, a microwave oven window could be constructed from a single panel supporting a single conductive thin film. The power transmission coefficient T of an infinitely wide single thin film to normally incident microwave plane wave is given by:

$$T = \left(\frac{2R}{\eta + 2R}\right)^2 \qquad \text{Eq. 5}$$

where η is the wave impedance; η≈377Ω in air and in vacuum. It is desirable to minimize R in order to minimize the microwave transmission. In principle, as explained above, R can be reduced by increasing the thickness of the thin film. However, all conducting thin film materials have some degree of optical absorbance, and thus adding thickness decreases the visibility. Furthermore, the cost of applying a thin film generally increases with the thickness. Furthermore, thicker films have more of a tendency to delaminate from the substrate than thinner films.

In contrast, certain embodiments dispose two parallel thin films, exhibiting optical transparency and electrical conductivity in an etalon arrangement. Because of wave interference effects within interstice 130, the transmission of an etalon depends on the distance between the thin films, i.e. length 135, and is given by:

$$T = \frac{\frac{R^2}{(R+\eta)^2}}{1 + \frac{\eta^2(\eta+2R)^2\sin^2\beta L}{4R^2(\eta+R)^2}} \quad \text{Eq. 6}$$

where β is the wave propagation coefficient within interstice 130, and L is length 135 of interstice 130. It may be seen that at L=0, and also at βL=nπ, where n is an integer, the microwave transmission is maximized and equivalent to that of a single film with double thickness, and thus having half of the R of each of the films comprising etalon 100. However when βL=nπ/2, and n=1, 3, 5 . . . , i.e. an odd integer number, the transmission is minimized. In the usual case of interest in which R<<η, Eq. 6 reduces to:

$$T_{min} \cong \frac{4R^4}{\eta^4} \quad \text{Eq. 7}$$

which shows a considerable advantage in a reduced transmission as compared with the case L=0 case, where $$T \cong \frac{R^2}{\eta^2}. \quad \text{Eq. 8}$$

FIGS. 4, 5, 7, and 8 present plots of the microwave power transmission as a function of length 135 of interstice 130, denoted L, assuming a microwave frequency of 2.45 GHz.

Figure 4:
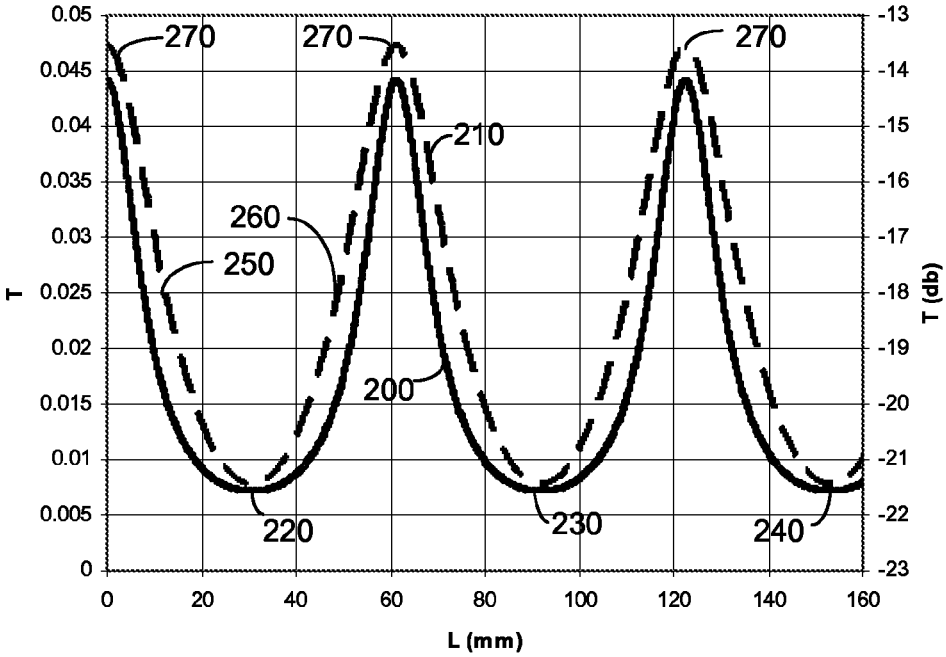
FIG. 4 is a graph of the calculated transmission coefficient of the microwave oven window of FIGS. 2-3, comprising two $100\Omega/\square$ transparent films exhibiting air in the interstice between the films, the transmission coefficient plotted as a function of the distance between the films.

FIG. 4 is a graph of the calculated transmission coefficient of a microwave oven window, such as observation window 40, comprising two 100Ω/□ transparent films exhibiting air, or another material exhibiting a dielectric constant or relative permittivity of approximately 1, in the interstice between the films, the transmission coefficient plotted as a function of the distance between the films in which the x-axis represents distance in millimeters for interstice 130, the left y-axis represent the fraction of incident microwave flux transmitted and the right y-axis represents attenuation in dB. Curve 200 represents transmission of incident microwave radiation through etalon 100 as a function of length 135 and is to be read in cooperation with the left y-axis. Curve 210 represents attenuation of incident microwave radiation through etalon 100 in dB and is to be read in cooperation with the right y-axis.

It may be seen that it would be advantageous to dispose the films so that length 135 is approximately 30 mm, or one quarter of the wavelength (λ/4) of the microwave radiation through the material constituting interstice 130, to minimize the microwave transmission as shown by point 220. A similar result is found at point 230 and 240 representing odd integer multiples of λ/4. Furthermore, considerable advantage is still obtained if the spacing is not exactly βL=nπ/2, but only approximately this spacing. If for example spacing L is either 0.1λ or 0.4λ, as illustrated by points 250, 260 respectively, then the transmission is approximately −18 db, which is only 3.5 db above the optimal (i.e. minimal) value obtained at λ/4, while having a 4.5 db advantage over the 0-spacing or λ/2 cases, as shown at points 270. In contrast, it may be seen that the microwave transmission is maximized at all spacing which are multiples, both even and odd, of a half-wavelength as shown at points 270.

Figure 5:
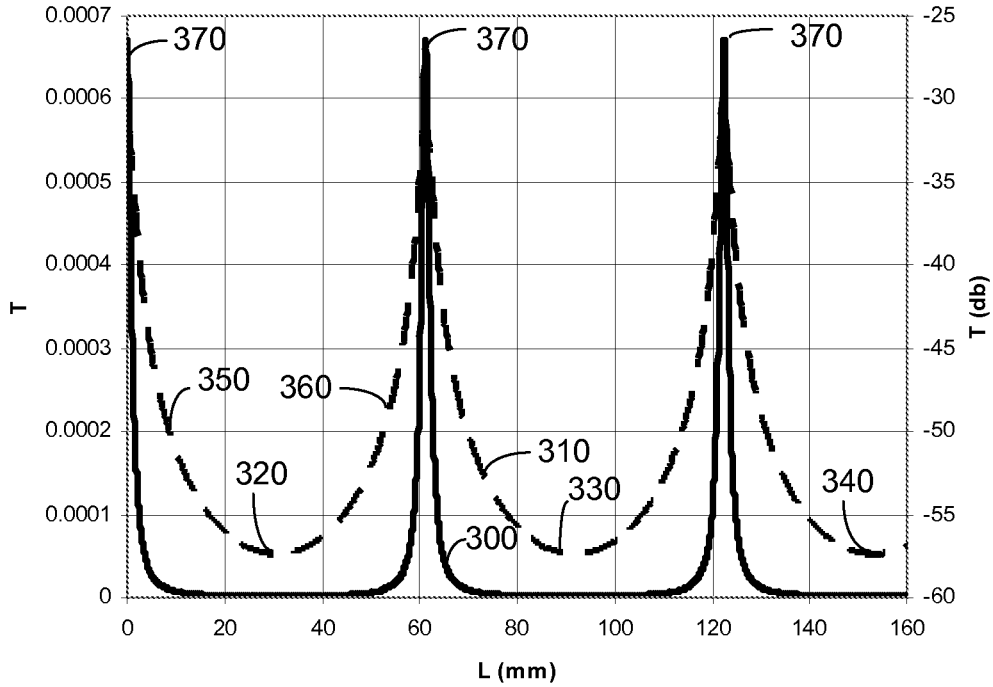
FIG. 5 is a graph of the calculated transmission coefficient of the microwave oven window of FIGS. 2-3 comprising two $10\Omega/\square$ transparent films exhibiting air in the interstice between the films, the transmission coefficient plotted as a function of the distance between the films.

FIG. 5 is a graph of the calculated transmission coefficient of a microwave oven window, such as observation window 40, comprising two 10Ω/□ transparent films exhibiting air, or another material exhibiting a dielectric constant or relative permittivity of approximately 1, in the interstice between the films, the transmission coefficient plotted as a function of the distance between the films in which the x-axis represents distance in millimeters for interstice 130, the left y-axis represents the fraction of incident microwave flux transmitted and the right y-axis represents attenuation in dB. Curve 300 represents transmission of incident microwave radiation through etalon 100 as a function of length 135 and is to be read in cooperation with the left y-axis. Curve 310 represents attenuation of incident microwave radiation through etalon 100 in dB and is to be read in cooperation with the right y-axis.

It may be seen that it would be advantageous to dispose the films so that length 135 is approximately 30 mm in air, or λ/4 of the microwave radiation through the material constituting interstice 130, to minimize the microwave transmission as shown by point 320. A similar result is found at each of point 330 and 340 representing odd integer multiples of λ/4. Furthermore, considerable advantage is still obtained if the spacing is not exactly βL=nπ/2, but only approximately this spacing. If for example spacing L is either 0.1λ or 0.4λ, as illustrated by points 350, 360 respectively, then the transmission is −52.45 db, which is only 4.5 db above the optimal (i.e. minimal) value obtained at λ/4, as shown at point 320, while having a 19.7 db advantage over the 0-spacing, or λ/2 case, as shown at points 370.

Figure 6:
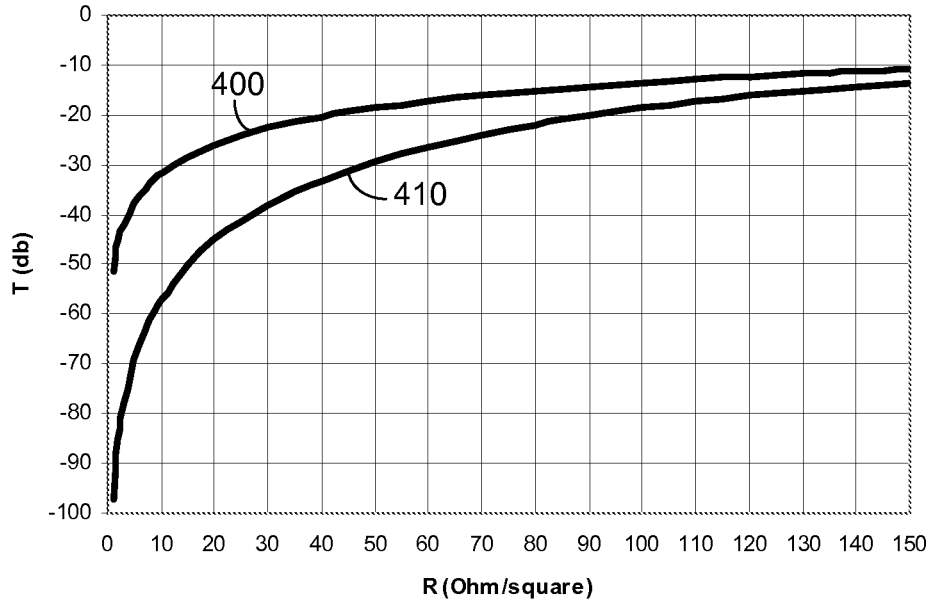
FIG. 6 is a graph of the calculated maximum and minimum transmission of microwave radiation impinging on an etalon composed of two conducting parallel films, as a function of their film resistance.

FIG. 6 is a plot of the minimum and maximum microwave transmission factors, $T_{max}$ and $T_{min}$, respectively curves 400, 410 for an etalon comprised of two films, such as etalon 100, each with resistivity R. $T_{max}$ is representative of an etalon exhibiting a length 135 of βL=nπ/2, where n is an even integer (0, 2, 4, etc.). $T_{min}$, is representative of an etalon exhibiting a length 135 of βL=nπ/2, where n is an odd integer (1, 3, 5, etc.). The x-axis represents resistivity R in Ω/□ and the y-axis represents transmission in db of microwave radiation incident on an etalon composed of two conducting parallel films, as a function of their film resistance. As described above in relation to Eq. 6, FIG. 4 and FIG. 5, curve 400 representing $T_{max}$ is equal to that obtained from a single film with surface resistivity R/2 and curve 410 illustrates the increased attenuation attributable to the etalon.

There are various embodiments and variations of the principles stated above. Referring to FIG. 3, interstice 130 may be filled with a transparent material having a higher than unity dielectric constant. This would be advantageous in reducing the required quarter-wavelength spacing length 135, because the wavelength in such a material would be smaller than in air. Similarly, interstice 130 may be filled with a material having a controlled degree of absorption of microwave radiation, in order to further decrease the transmission. In one embodiment, interstice 130 is constituted of a transparent material which exhibits both an index of refraction greater than unity, and a controlled degree of microwave absorbance. In a further embodiment, the transparent material constituting interstice 130 comprises water. Water is particularly advantageous because it has a large microwave reflectance, a small microwave penetration depth, a large specific heat, and low cost.

Figure 7:
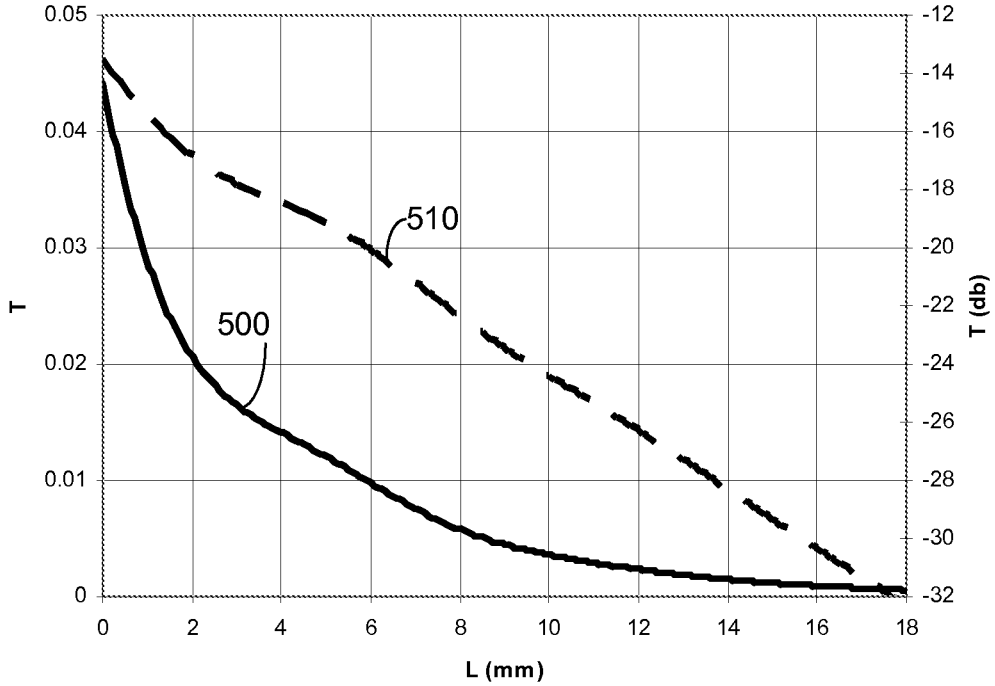
FIG. 7 is a graph of the calculated transmission coefficient of a microwave oven window comprising two $100\Omega/\square$ transparent films exhibiting water in the interstice between the films, the transmission coefficient plotted as a function of the distance between the films.

FIG. 7 is a graph of the calculated transmission coefficient of a microwave oven window, such as observation window 40, comprising two 100Ω/□ transparent films exhibiting water in interstice 130 between the films, the transmission coefficient plotted as a function of the distance between the films in which the x-axis represents distance in millimeters for interstice 130, the left y-axis represents the fraction of incident microwave flux transmitted and the right y-axis represents attenuation in dB. Curve 500 represents transmission of incident microwave radiation through etalon 100 as a function of length 135 and is to be read in cooperation with the left y-axis. Curve 510 represents attenuation of incident microwave radiation through etalon 100 in dB and is to be read in cooperation with the right y-axis. For clarity the x-axis has been expanded to show the area between 0 and about λ/8, with the wavelength defined in the material constituting interstice 130.

Figure 8:
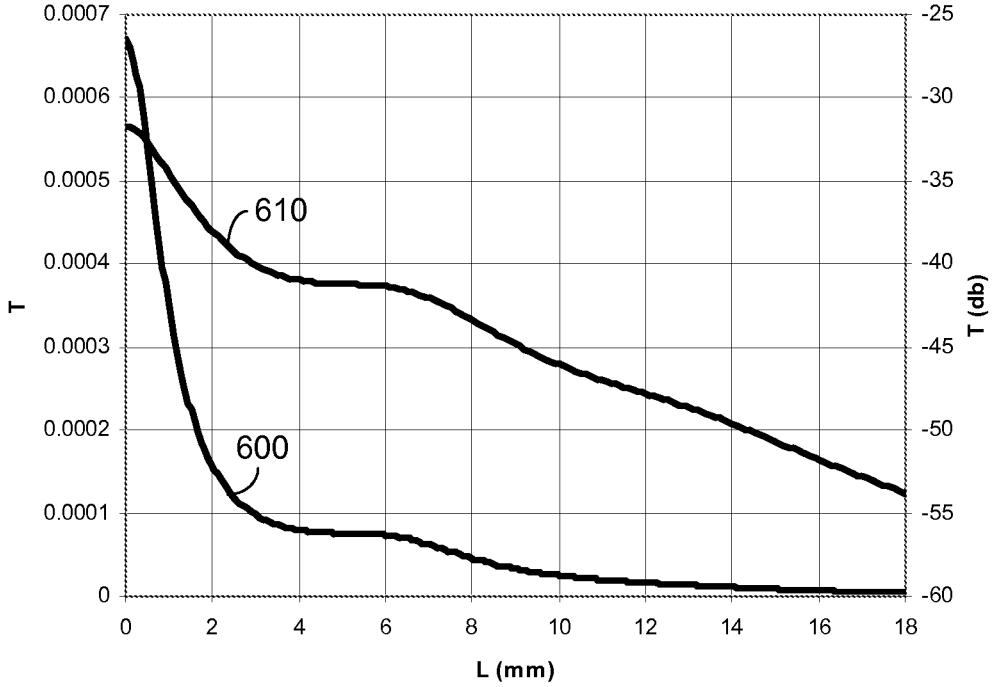
FIG. 8 is a graph of the calculated transmission coefficient of a microwave oven window comprising two $10\Omega/\square$ transparent films exhibiting water in the interstice between the films, the transmission coefficient plotted as a function of the distance between the films.

FIG. 8 is a graph of the calculated transmission coefficient of a microwave oven window, such as observation window 40, comprising two 10Ω/□ transparent films exhibiting water in interstice 130 between the films, the transmission coefficient plotted as a function of the distance between the films in which the x-axis represent distance in millimeters for interstice 130, the left y-axis represent the fraction of incident microwave flux transmitted and the right y-axis represents attenuation in dB. Curve 600 represents transmission of incident microwave radiation through etalon 100 as a function of length 135 and is to be read in cooperation with the left y-axis. Curve 610 represents attenuation of incident microwave radiation through etalon 100 in dB and is to be read in cooperation with the right y-axis. For clarity the x-axis has been expanded to show the area between 0 and about λ/8, with the wavelength defined in the material constituting interstice 130.

The above calculations are presented to explain the effect of the etalon in simple terms. They neither take into account the effect of the panel materials, nor the effect of finite geometry, nor the fact that the incident radiation striking the microwave oven window from inside a microwave oven will be distributed over a range of angles of incidence. The performance parameters of a particular device would depend on all of the above, which in general are dependent on the device design, and its operating conditions. The amount, composition and location of food placed within a microwave oven, for example, would affect the angular distribution and quantity of radiation reaching the microwave oven window.

It is instructive to compare the curves of FIGS. 7 and 8 with the corresponding curves of FIGS. 4 and 5. It may be seen that considerable increased attenuation is obtained with a much smaller L when interstice 130 is filled with water as compared to air. In an exemplary embodiment, the water used to fill interstice 130 is treated to prevent microbial growth and to minimize corrosion of the thin films or other surfaces which the water contacts. In another embodiment interstice 130 is constituted of a solution of two liquids. In one further embodiment, one of the two liquids is constituted of water.

In the configuration shown in FIG. 3, thin transparent conductive films 120 and 121 are applied on the sides of transparent panels 110 and 111 facing interstice 130. This configuration is particularly advantageous in the event that the transparent conductive films are fragile, for they are thus protected from inadvertent mechanical damage due to handling and cleaning. Furthermore, interstice 130 may be filled with a benign atmosphere such as dry air or nitrogen or a noble gas, to prevent oxidation degradation of the thin films. In one embodiment a controlled amount of water vapor is added to the benign atmosphere.

In other embodiments (not shown), one or both of the thin films could be applied on the exterior side of the panels. This would be particularly beneficial if the thin film is harder than the panel, as it could then help protect the panel from scratching. Also, convective cooling of the films may be enhanced by this disposition. Furthermore, the total thickness of the microwave oven window, i.e. observation window 40, would then be smaller than the configuration shown in FIG. 3, since transparent panels add to length 135 of interstice 130, and because the dielectric constant of the panels is generally greater than unity, and hence the wavelength within the panels is less than in air.

Figure 9:
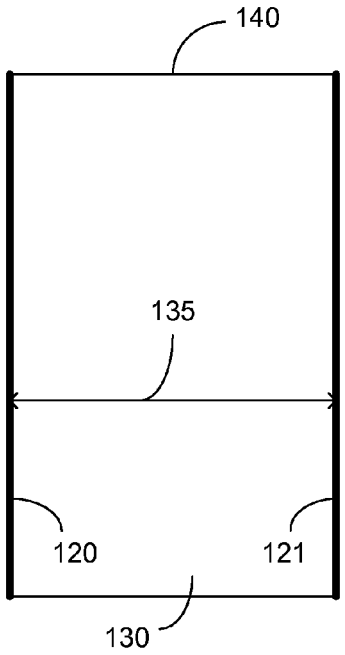
FIG. 9 is a high level schematic diagram of an embodiment of a microwave oven window in which the transparent films are supported by a single transparent panel.

In another embodiment of the microwave oven window, such as observation window 40, illustrated in FIG. 9, thin transparent conductive films 120 and 121 are applied to both major surfaces of a single panel 140, whose thickness defines length 135 of interstice 130 and is preferably chosen to be equal to approximately an odd integer multiple of a quarter wavelength of the microwave radiation in the panel material.

Figure 10:
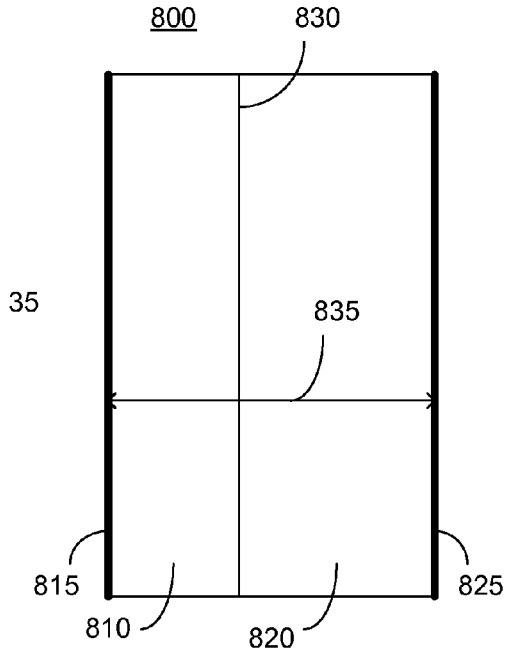
FIG. 10 is a high level schematic diagram of an embodiment of a microwave oven window constituted of a pair of transparent panels each exhibiting a transparent film coating on one side, in which the transparent films are supported by the transparent panels disposed so that the uncoated surfaces of the panels abut each other.

The principle illustrated in FIG. 9 is more economically realized in the embodiment illustrated in FIG. 10, where microwave oven window 800 is constituted of a pair of transparent panels 810, 820 each coated on a single major surface thereof with respective transparent conductive films 815, 825. The uncoated major surface of transparent panels 810 and 820 abut each other, forming a seam line 830, and transparent panel 810 abuts chamber 35, and particularly conductive film 815 of transparent panel 810. Transparent panels 810, 820 are in one embodiment constituted of float glass. This is economically advantageous because float glass with a single side coated by atmosphere pressure chemical vapor deposition is inexpensive and readily available. In one embodiment, the thickness of each transparent panel 810, 820 is approximately 4 mm, and is constituted of glass, preferably float glass, so that the total distance between films 815, 825, illustrated as spacing 835, is approximately 8 mm. Selecting a glass with a dielectric constant of k=6.54 for each of transparent panels 810, 820, spacing 835 between films 815, 825 is 0.167 of a wavelength. It is preferential that glass panels 810, 820 be tempered in order to increase their resistance to thermal shock, and thus to prevent cracking. In another embodiment (not shown), a small air space is provided between the panels to reduce thermal conductivity between the panels. In this embodiment, transparent panel 810, defining one end of chamber 35, is preferably tempered, while tempering of transparent panel 820 is optional.

Figure 11:
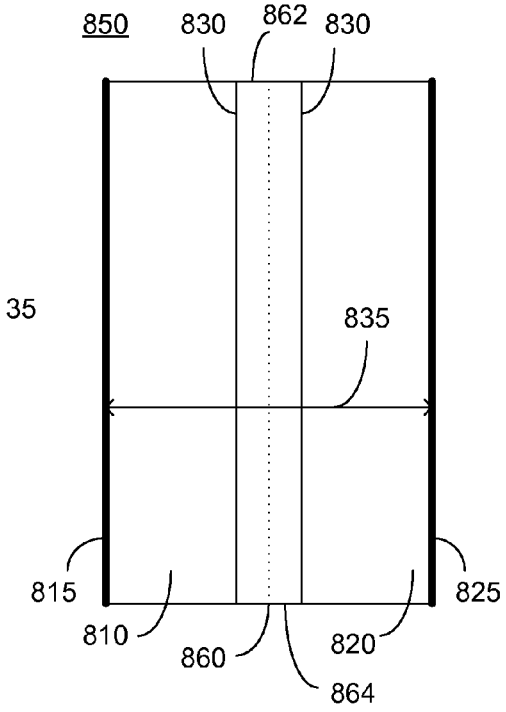
FIG. 11 is a high level schematic diagram of an embodiment of a microwave oven window constituted of a pair of transparent panels each exhibiting a transparent film coating on one side and an additional uncoated transparent panel, in which the transparent films are supported by the two transparent panels and the additional transparent panel is inserted between the pair of coated transparent panels, with the coated panels disposed such that their uncoated surfaces each abut one surface of the uncoated transparent panel.

FIG. 11 is a high level schematic diagram of an embodiment of a microwave oven window 850 constituted of a pair of transparent panels 810, 820 each coated on a single major surface thereof with respective transparent conductive films 815, 825, and an additional uncoated transparent panel 860. The uncoated major surfaces of transparent panels 810 and 820 are arranged to each abut an opposing side of uncoated transparent panel 860, forming seam lines 830. Transparent panel 810, particularly conductive film 815 of transparent panel 810, abuts chamber 35. Transparent panels 810, 820 and 860 are in one embodiment constituted of float glass. In one illustrative embodiment, transparent panels 810, 820 are fabricated from float glass each with a thickness of 3 mm on which coatings of F-doped tin oxide were applied during glass fabrication using atmospheric pressure chemical vapor deposition, and uncoated transparent panel 860 is constituted of float glass with a thickness of 4 mm. Uncoated float glass is less expensive than coated glass, and readily available. The total distance between films 815, 825, illustrated as length 835, is approximately 10 mm. Selecting a glass with a dielectric constant of k=6.54 for each of transparent panels 810, 820 and 860, spacing 835 is 0.21 of a wavelength, and thus very close to the ideal quarter wave spacing. In one embodiment, preferably each of transparent panels 810, 820 and 860 are tempered. In another embodiment a small air space is provided over most the surface between transparent coated panel 810 defining chamber 35 and uncoated transparent panel 860; in this case it is preferred that transparent coated panel 810 be tempered, while tempering of transparent panels 820 and 860 is optional.

Figure 12:
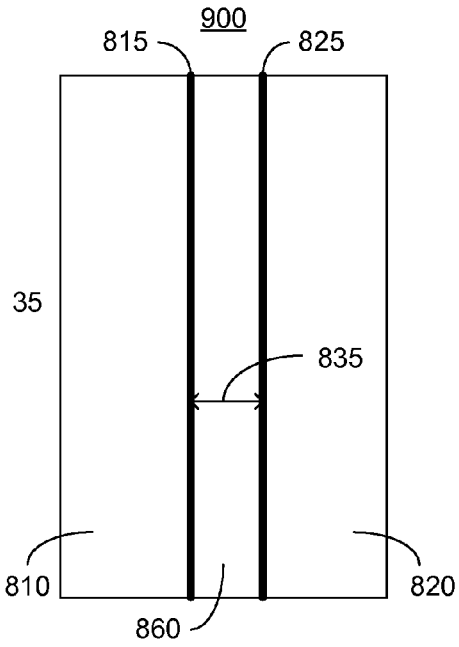
FIG. 12 is a high level schematic diagram of an embodiment of a microwave oven window constituted of a pair of transparent panels each exhibiting a transparent film coating on one side and an additional uncoated transparent panel, in which the transparent films are supported by the two transparent panels and the additional transparent panel is inserted between the pair of coated transparent panels, with the coated panels disposed such that their coated surfaces each abut one surface of the uncoated transparent panel.

In the embodiments described in FIGS. 10 and 11, conductive films 815, 825 form the outermost layers of microwave oven window 800, 850, and are thus exposed to the environment, food splatter, user handling and user cleaning. In another embodiment illustrated in FIG. 12, a microwave oven window 900 is illustrated constituted of a pair of transparent panels 810, 820 each coated on a single major surface with respective transparent conductive films 815, 825, and an additional transparent panel 860. Preferably, additional transparent panel 860 is uncoated. Transparent conductive films 815, 825 are arranged to each abut an opposing major surface of additional transparent panel 860. Transparent panel 810, particularly the uncoated major surface of transparent panel 810, abuts chamber 35. This embodiment is advantageous in that the outer glass panels 810, 820 protect conductive film 815, 825 from food splatter and user abuse. Preferably transparent panels 810, 820 and additional transparent panel 860 are each fabricated from float glass, and film coatings 815, 825 are applied using atmospheric pressure chemical vapor deposition during the fabrication of the glass panels. The total distance between films 815, 825, illustrated as length 835 is thus substantially determined by the thickness of additional transparent panel 860. In a preferred embodiment, the thickness of additional transparent panel 860 is chosen to be approximately 12 mm, i.e. approximately one quarter wavelength in float glass having a dielectric constant of 6.25. In one embodiment all panels are tempered. In another embodiment a small air space is provided over most the surface area between transparent panel 810 and additional transparent panel 860, to decrease thermal conduction to panels 860, 820.

The above has been illustrated in an embodiment in which additional transparent panel 860 is constituted of a single panel, however this is not meant to be limiting in any way. In another embodiment, additional transparent panel 860 comprises a plurality of transparent panels abutted to each other at a major face of each, as illustrated in FIG. 11 by first additional transparent panel 862 and second additional transparent panel 864. Such an embodiment allows for selection of commercially available transparent panels to be effectively stacked so as to arrive at the desired etalon thickness. Thus, additional transparent panel 860 is in one embodiment composed of a single transparent panel, and in another embodiment additional transparent panel 860 is constituted of a stack of transparent panels. Preferably, each of first additional transparent panel 862 and second additional transparent panel 864 are uncoated transparent panels.

Figure 13:
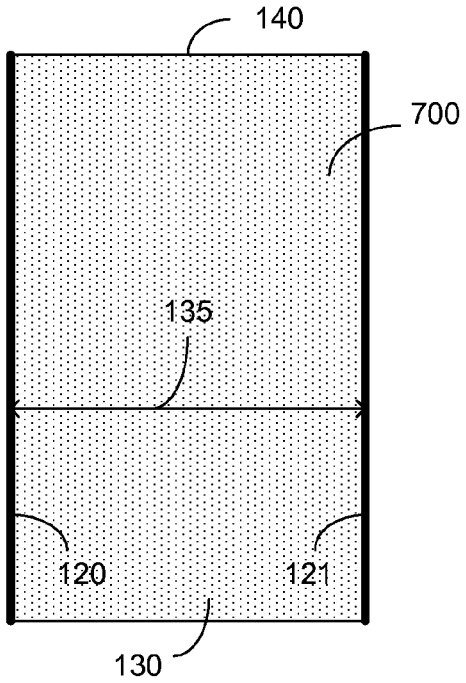
FIG. 13 is a high level schematic diagram showing an embodiment of the single transparent panel of FIG. 9 in which the interstice between the transparent films comprises wires.

FIG. 13 is a high level schematic diagram of an embodiment of panel 140 of FIG. 9 in which the interstice between the transparent films comprises wires. The absorbance of panel 140 is enhanced by dispersing therein thin wires 700 having a length $L_w$ approximately equal to one half wavelength of the microwave radiation within the material, and oriented generally parallel to the plane of the thin transparent conductive films 120 and 121. Preferably the wires should be sufficiently thin so that they are virtually invisible, and preferably the resistance of each wire should be approximately equal to the radiation resistance of a half-wavelength dipole antenna within the material, given by $R_w \approx 72\Omega/\sqrt{k}$. The ideal diameter of such wires is given by:

$$D = \frac{L_w}{\pi R_w \sigma_w \delta} \quad \text{Eq. 9}$$

where δ is the skin depth given by:

$$\delta = \sqrt{\frac{2}{\omega \sigma_w \mu_w}} \quad \text{Eq. 10}$$

and where ω is the angular frequency of the radiation, $\sigma_w$ is the electrical conductivity of the wire material, and $\mu_w$ is the magnetic permeability of the wire. As an example, with 2.45 GHz radiation, and polycarbonate panel material with a dielectric constant of k=3.2, this can be obtained with copper wires with approximate length 34 mm and approximate diameter 3.5 μm. Ideally these wires should be dispersed within the panel with random orientation within the panel plane, and with a density approximately equal to the inverse of the ideal dipole antenna capture cross section, given by $$\frac{3\lambda_p^2}{8\pi},$$

where $\lambda_p$ is the wavelength in the panel, and thus in the present case, approximately 1800 wires per $m^2$ of panel area.

In certain embodiments, thin transparent conducting films are applied to faces of glass panels facing interstice 130 as shown in FIG. 3, and the glass panels are mounted to a window frame such that thermally insulating material separates it from the frame. This minimizes thermal conduction from the glass panel to the frame, which is generally constructed of a metal which is a better thermal conductor than the glass panel. This reduces conductive cooling at the edges of the glass panel, and hence improves the homogeneity of the glass temperature, and thus reduces thermal stress in the glass, and the chance of cracking.

Figure 14:
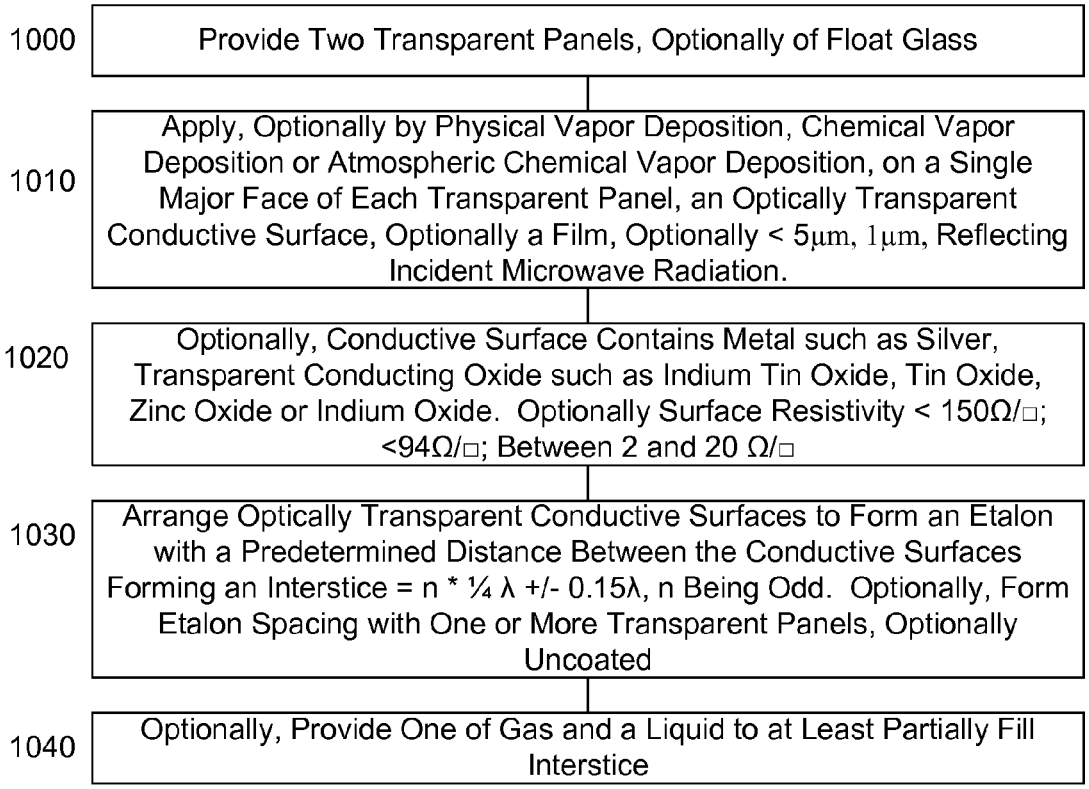
FIG. 14 is a high level flow chart of an exemplary embodiment of a method for attenuating microwave radiation.

FIG. 14 is a high level flow chart of an exemplary embodiment of a method for attenuating microwave radiation. In stage 1000 two transparent panels are provided, the term transparent being particularly defined as substantially transparent to wavelengths sensed by the human eye. Optionally, the transparent panels are constituted of float glass.

In stage 1010, an optically transparent conductive surface is applied on a single major face of each of the transparent panels of stage 1000. Optionally, the transparent conductive surface is applied by one of physical vapor deposition, chemical vapor deposition and atmospheric pressure chemical vapor deposition. Optionally, the transparent conductive surface is a film, and optionally the conductive surface or film exhibits a thickness of less than 5 μm, preferably less than 1 μm. In one particular embodiment, the optically transparent conductive surface is applied by atmospheric pressure chemical vapor deposition during production of the optional float glass of stage 1000.

In optional stage 1020, the transparent conductive surface, or film, of stage 1010 is constituted of a metal, preferably silver, or a transparent conducting oxide, preferably one of indium tin oxide, tin oxide, zinc oxide or indium oxide. Optionally, the surface resistivity is selected to be less than 150Ω/□, preferably less than 94Ω/□, and further preferably between 2 and 20Ω/□.

In stage 1030, the optically transparent conductive surfaces are arranged to form an etalon, as described above in relation to any of FIGS. 3 and 9-13. The predetermined distance between the optically transparent conductive surfaces form an interstice with a length of an odd integer multiple of a quarter-wavelength of the microwave radiation plus or minus 0.15 wavelength. The wavelength is defined in the interstice between the optically transparent conductive surfaces.

Optionally, the etalon is formed by placing one or more transparent panels, optionally uncoated transparent panels, between the optically transparent conductive surfaces deposited on transparent panels.

In optional stage 1040, one of a gas and a liquid is provided to at least partially fill the interstice of stage 1030.

EXAMPLES

The embodiments described herein can be best appreciated by examination of several examples. A test set-up was constructed using a commercial domestic microwave oven (Graetz model mw 801E) as a basis. The door was modified such that the original microwave oven window with its metal grid radiation attenuator was removed, and either a single 15.5×28 cm glass panel with a transparent conductive film, or two 15.5×28 cm glass panels with transparent conductive films, in the configuration described schematically in FIG. 3, with a spacing between the films of 30 mm, which is approximately equal to ¼ Of the microwave wavelength, were mounted thereon. The edge of the door was sealed with metal foil to prevent stray radiation from the gap between the door and body of the oven. Tests were conducted by placing a beaker with a predetermined amount of water in the center of the oven, and operating the oven for a predetermined amount of time. The microwave radiation was measured with a radiation meter (EMF Inc., model number MD-2000) at various lateral locations 5 cm outside of the outer panel, as specified in various safety standards. In some cases the water temperature and the glass temperature were also measured.

Various coated glass samples, described in Table I, were tested with the set-up described above with the predetermined amount of water being 250 ml. It should be noted that the radiation leakage varied over the area of the microwave oven window. The maximum radiation leakage for each sample is listed in Table I. It may be noted that none of the single pane samples met the 5 mW/cm$^2$ safety standard. Of the two-panel etalon samples, sample 1, with R=24Ω/□, did not meet the safety standard of 5 mW/cm$^2$, sample 2 was borderline, and samples 3 and 4 greatly surpassed the safety standard.

TABLE I

| Sample # | 1 | 2 | 3 | 4 |
|---|---|---|---|---|
| Glass Supplier Description Coating Material | AFG Comfort Lowe Fluorine doped tin oxide | AFG PV-TCO Fluorine doped tin oxide | PILKINGTON TEC7 Fluorine doped tin oxide | AFG TiAC36 Silver based low-e |
| R[Q/□] | 24 | 12.6 | 8 | 2.6 |
| Maximum Leakage (1 pane) mW/cm$^2$ | >10 | >10 | >10 | 6 |
| Maximum Leakage (2 panes, λ/4 spacing) mW/cm$^2$ | 10 | 5 | 0.9 | <0.01 |

Samples 1-3 all cracked at some point during tests performed under the above conditions, but the cracking did not adversely affect the microwave radiation leakage. Cracking was not observed in Sample 4.

Cracking was prevented, however, by making two further modifications to the microwave oven. First, as described above, a standard fluorescent lamp (Mitsushi 8W DL 220V 01/05) was mounted along the upper rear corner of chamber 35. The lamp was not directly connected to an electrical supply, but rather was excited by the microwave radiation in chamber 35. Additionally, as described above, the fan was operated from the time that microwave energy was first applied, to a time at least 30 seconds after the microwave radiated ceased. Under these circumstances, no cracking was observed in any tests performed in the 2-pane configuration with samples 3 and 4.

Thus, certain embodiments enable a microwave oven window exhibiting improved visibility while attenuating microwave radiation, the microwave oven window comprising a pair of optically transparent panels, such as float glass, to which a substantially transparent conductive film which reflects microwave radiation has been applied to a single major surface thereof. The two transparent conductive films are optimally spatially separated by a predetermined distance equal to approximately an odd number of quarter wavelengths of the microwave radiation in the interstice between the two films. In certain embodiments, the microwave oven window is comprised of two parallel panes of float glass where the uncoated major faces abut each other thereby defining the interstice. In one particular embodiment the transparent conductive film is applied by atmospheric pressure chemical vapor deposition, applied in-line during the fabrication of the float glass.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description and which are not in the prior art.

We claim:

1. An observation window for a microwave device exhibiting microwave radiation of a predetermined frequency, the observation window comprising:

a first transparent panel having a first major surface and a second major surface opposing said first major surface, said first transparent panel having a first predetermined thickness defining the distance between the first major surface and the second major surface thereof, said first major surface of said first transparent panel having a first optically transparent conductive film, which primarily reflects incident microwave radiation, applied thereto, and said second major surface of said first transparent panel not exhibiting an optically transparent conductive film, which primarily reflects incident microwave radiation, applied thereto; and a second transparent panel having a first major surface and a second major surface opposing said first major surface, said second transparent panel having a second predetermined thickness defining the distance between the first major surface and the second major surface thereof, said first major surface of said second transparent exhibiting a second optically transparent conductive film, which primarily reflects incident microwave radiation, applied thereto, and said second major surface of said second transparent panel not exhibiting an optically transparent conductive film which primarily reflects incident microwave radiation, applied thereto, wherein said second major surface of said first transparent panel abuts said second major surface of second transparent panel such that the first optically transparent conductive film is substantially parallel with the second optically transparent conductive film, and wherein the first predetermined thickness and the second predetermined thickness define a predetermined spatial separation of the first optically transparent conductive film from the second optically transparent conductive film, said predetermined spatial separation defining an interstice, said predetermined spatial separation being equal to an odd integer multiple of one quarter of the wavelength of the microwave radiation of the predetermined frequency in the interstice between said first and second transparent conductive films, said predetermined distance having a tolerance of plus or minus 0.15 of said wavelength in the interstice.

2. An observation window, for a microwave device exhibiting microwave radiation of a predetermined frequency, the observation window comprising:

a first transparent panel having a first major surface and a second major surface opposing said first major surface, said first transparent panel having a first predetermined thickness defining the distance between the first major surface and the second major surface thereof, said first major surface of said first transparent panel having a first optically transparent conductive film, which primarily reflects incident microwave radiation, applied thereto, and said second major surface of said first transparent panel not exhibiting an optically transparent conductive film, which primarily reflects incident microwave radiation, applied thereto; and a second transparent panel having a first major surface and a second major surface opposing said first major surface, said second transparent panel having a second predetermined thickness defining the distance between the first major surface and the second major surface thereof, said first major surface of said second transparent exhibiting a second optically transparent conductive film, which primarily reflects incident microwave radiation, applied thereto, and said second major surface of said second transparent panel not exhibiting an optically transparent conductive film which primarily reflects incident microwave radiation, applied thereto; and a third transparent panel having a first major surface and a second major surface opposing said first major surface and a third predetermined thickness defining the distance between the first major surface and the second major surface of the third transparent panel, wherein said second major surface of said first transparent panel abuts the first major surface of said third transparent panel and said second major surface of said second transparent panel abuts the second major surface of said third transparent panel such that the first optically transparent conductive film is substantially parallel with the second optically transparent conductive film, the combination of the first predetermined thickness, the second predetermined thickness and the third predetermined thickness defines a predetermined spatial separation of the first optically transparent conductive film from the second optically transparent conductive film, said predetermined spatial separation defining an interstice, said predetermined spatial separation being equal to an odd integer multiple of one quarter of the wavelength of the microwave radiation of the predetermined frequency in the interstice between said first and second transparent conductive films, said predetermined distance having a tolerance of plus or minus 0.15 of said wavelength in the interstice.

3. An observation window for a microwave device exhibiting microwave radiation of a predetermined frequency, the observation window comprising:

a first transparent panel having a first major surface and a second major surface opposing said first major surface, said first major surface of said first transparent panel having a first optically transparent conductive film, which primarily reflects incident microwave radiation, applied thereto, and said second major surface of said first transparent panel not exhibiting an optically transparent conductive film, which primarily reflects incident microwave radiation, applied thereto; and a second transparent panel having a first major surface and a second major surface opposing said first major surface, said first major surface of said second transparent exhibiting a second optically transparent conductive film, which primarily reflects incident microwave radiation, applied thereto, and said second major surface of said second transparent panel not exhibiting an optically transparent conductive film which primarily reflects incident microwave radiation, applied thereto; and a third transparent panel having a first major surface and a second major surface opposing said first major surface and a predetermined thickness defining the distance between the first major surface and the second major surface of the third transparent panel, wherein said first major surface of said first transparent panel abuts the first major surface of said third transparent panel and said first major surface of said second transparent panel abuts the second major surface of said third transparent panel opposing said first major face of said third transparent panel, such that the first optically transparent conductive film is substantially parallel with the second optically transparent conductive film, and the predetermined thickness of said third transparent panel defines a predetermined spatial separation of the first optically transparent conductive film from the second optically transparent conductive film, said predetermined spatial separation defining an interstice, said predetermined spatial separation being equal to an odd integer multiple of one quarter of the wavelength of the microwave radiation of the predetermined frequency in the interstice between said first and second transparent conductive films, said predetermined distance having a tolerance of plus or minus 0.15 of said wavelength in the interstice.

4. An observation window according to claim 2, wherein said third transparent panel is constituted of a plurality of transparent panels each of the constituent plurality of transparent panels exhibiting a major surface abutted to a major surface of another of the constituent plurality of transparent panels.

5. An observation window according to claim 1, where said first transparent panel and said second transparent panel are each comprised of float glass, and wherein said first and second optically transparent conductive films are applied to said first major surface of said first and second optically transparent panels, respectively, by atmospheric pressure chemical vapor deposition.

6. An observation window according to claim 1, wherein at least one of said first and second optically transparent films contains a layer of a metal.

7. An observation window according to claim 6, where said metal is silver.

8. An observation window according to claim 1, where at least one of said first and second optically transparent films comprises a layer of a transparent conducting oxide.

9. An observation window according to claim 8, wherein said layer of a transparent conducting oxide comprises one of indium tin oxide, tin oxide, zinc oxide and indium oxide.

10. An observation window according to claim 1, wherein said interstice has disposed therein wires having a length of approximately one half of the microwave radiation wavelength in said interstice.

11. An observation window according to claim 10, wherein said wires are generally parallel to said optically transparent conductive films.

12. An observation window according to claim 10, wherein said wires are of a width so that they are not visible to the naked eye.

13. An observation window according to claim 10, wherein said wires have a resistance approximately equal to the radiation resistance of a half-wave dipole antenna in said interstice.

14. An observation window according to claim 10, wherein said wires are arranged with a density of about the inverse of the ideal dipole antenna capture cross section.

15. An observation window according to claim 1, wherein the surface resistivity of at least one of said first and second optically transparent conductive films is less than 150Ω/□.

16. An observation window according to claim 1, wherein the surface resistivity of at least one of said first and second optically transparent conductive films is less than 94Ω/□.

17. An observation window according to claim 1, wherein the surface resistivity of at least one of said first and second optically transparent conductive films is between 2 and 20Ω/□.

18. An observation window according to claim 1, wherein the thickness of at least one of said first and second optically transparent conductive films is less than 5 μm.

19. An observation window according to claim 1, wherein the thickness of at least one of said first and second optically transparent conductive films is less than 1 μm.

20. An observation window according to claim 1, wherein the odd integer is 1.

21. An observation window according to claim 3, wherein said third transparent panel is constituted of a plurality of transparent panels each of the constituent plurality of transparent panels exhibiting a major surface abutted to a major surface of another of the constituent plurality of transparent panels.

* * * * *